US005763818A

United States Patent [19]

Guymon et al.

[11] Patent Number: 5,763,818

[45] Date of Patent: Jun. 9, 1998

[54] ILLUMINANT IGNITER PELLET IGNITION SYSTEM FOR USE IN A DECOY FLARE

[75] Inventors: Ross W. Guymon, Providence; David W. Endicott, Jr., Mendon; Ralph S. Tappan, II, Brigham City, all of Utah

[73] Assignee: Thiokol Corporation, Ogden, Utah

[21] Appl. No.: 705,193

[22] Filed: Aug. 29, 1996

Related U.S. Application Data

[63] Continuation-in-part of Ser. No. 497,277, Jun. 30, 1995, Pat. No. 5,610,364.

[60] Provisional application No. 60/004,129 Sep. 22, 1995.

[51] Int. Cl.[6] ..... F42B 4/26; F42C 15/34

[52] U.S. Cl. ..... 102/336; 102/342; 102/343; 102/249; 102/254; 102/256; 102/275.11

[58] Field of Search ..... 102/336, 342, 102/343, 275.11, 247, 249, 254, 256

[56] References Cited

U.S. PATENT DOCUMENTS

| | | | |
|---|---|---|---|
| 3,670,657 | 6/1972 | Evans | 102/87 |
| 3,964,393 | 6/1976 | Foote et al. | 102/37.6 |
| 4,286,498 | 9/1981 | Block et al. | 86/1 R |
| 4,419,934 | 12/1983 | Apotheloz | 102/233 |
| 4,454,816 | 6/1984 | Billard et al. | 102/430 |
| 4,503,773 | 3/1985 | Bolieau | 102/202 |
| 4,621,579 | 11/1986 | Badura et al. | 102/334 |
| 4,624,186 | 11/1986 | Widera et al. | 102/336 |
| 4,815,381 | 3/1989 | Bullard et al. | 102/247 |
| 4,986,184 | 1/1991 | Kude | 102/256 |
| 5,131,328 | 7/1992 | Chan | 102/229 |
| 5,136,950 | 8/1992 | Halpin et al. | 102/336 |
| 5,343,794 | 9/1994 | Andreotti et al. | 89/1.11 |
| 5,347,931 | 9/1994 | Day | 102/340 |
| 5,585,594 | 12/1996 | Pelham et al. | 102/336 |

FOREIGN PATENT DOCUMENTS

| | | | |
|---|---|---|---|
| 2025005 | 1/1980 | United Kingdom | 102/256 |

OTHER PUBLICATIONS

U.S.S.I.R. #H 1603, Decard et al., Nov. 5, 1996.

*Primary Examiner*—Peter A. Nelson

*Attorney, Agent, or Firm*—Cushman Darby & Cushman IP Group of Pillsbury Madison & Sutro LLP; Ronald L. Lyons

[57] ABSTRACT

A decoy flare ignition system is disclosed which includes an ignition initiator disposed at the aft end of the flare housing. An illuminant igniter is positioned in direct contact with the flare illuminant. The illuminant igniter includes at least one illuminant igniter pellet selected such that the firing of the ignition initiator triggers combustion of the illuminant igniter pellet if the safe-and-initiation device has been actuated. The igniter pellet is preferably configured as a circular cylindrical shell and is positioned over the bore of the flare illuminant.

20 Claims, 3 Drawing Sheets

ILLUMINANT IGNITER PELLET IGNITION SYSTEM FOR USE IN A DECOY FLARE

This application is a continuation in part of application Ser. No. 08/497,277 filed Jun. 30, 1995, now U.S. Pat. 5,610,364 and entitled NOZZLE PLUG FOR PLUME ENHANCEMENT IN A KINEMATIC FLARE.

BACKGROUND

1. Related U.S. Application

This application is related to United States Provisional Application of Ross W. Guymon, David W. Endicott, Jr., and Ralph S. Tappan II, Ser. No. 60/004,129, filed Sep. 22, 1995 and entitled ILLUMINANT IGNITER PELLET IGNITION SYSTEM FOR USE IN A DECLY FLARE which provisional application is incorporated herein by this reference.

2. The Field of the Invention

The present invention is related to an improved ignition system for igniting the flare illuminant in a decoy flare. More particularly, the ignition system of the present invention utilizes an igniter pellet bonded to the flare illuminant to directly ignite the flare illuminant thus obviating the need of a combustible train.

3. Technical Background

Decoy flares are used defensively by combat aircraft to evade heat-seeking missiles directed at such aircraft by an enemy. At an appropriate time after the enemy launches a heat-seeking missile, the targeted aircraft releases a decoy flare. The decoy flare burns in a manner that simulates the engines of the targeted aircraft. Ideally, the missile locks onto and pursues the decoy, permitting the targeted aircraft to escape unharmed.

Missile technology advancements have led to discriminating abilities in missiles to distinguish between the target aircraft and the decoy flare. This has led to the development of kinematic, or fly-along, flares to beat or decoy the advanced discriminators found in the missiles. Such flares employ a flare illuminant which is a propellant.

Such flares are generally stored in a cartridge or canister on aircraft and are deployed by igniting an impulse cartridge which ejects the flare from the cartridge and triggers a chain of events which leads to the ignition of the flare illuminant.

Safety regulations for such decoy flares require that flares satisfy "lock-set" test requirements. These requirements are designed to ensure that in the event the flare dispenser is plugged, thereby blocking physical deployment of the flare, ignition of the impulse cartridge will not trigger ignition of the flare illuminant. Generally this is accomplished by employing a safe-and-initiation device which prevents the illuminant from being ignited until the flare has been ejected from the canister, thereby ensuring that the flare canister has not been blocked prior to igniting the illuminant.

It will be appreciated that the rapid ignition and deployment of the decoy flare is imperative to the function of the flare and the safety of the targeted aircraft. One current ignition system employs a safe-and-initiation system which separates an ignition initiator from the illuminant igniter. Upon actuation of the safe-and-initiation device, the physical barrier it provides between the ignition initiator and the illuminant igniter is removed and the ignition initiator is permitted to ignite the illuminant igniter. The illuminant igniter then ignites the flare illuminant.

In one current flare design, the illuminant igniter comprises a combustible train which runs the length of a longitudinal bore extending through the center of the flare illuminant. The actuation of the safe-and-initiation device exposes the combustible train to the shock generated by the ignition initiator, thereby triggering the combustion of the combustible train. The combustible train then ignites pyrotechnic pellets of $BKNO_3$ positioned at the forward end of the flare which, in turn, ignite the propellant grain. In these ignition systems the combustible train is bonded to the propellant grain.

The ignition system of a decoy flare is subject to harsh environmental conditions and must be able to withstand the heavy turbulence and vigorous vibrations created during the operation of the aircraft. At the same time, flare ignition systems may be subjected to rapid temperature fluctuations ranging from as high as 135 degrees Fahrenheit on the ground to as low as −40 degrees Fahrenheit at high altitudes. As a result of these extreme conditions, the bond between the combustion train and the illuminant grain may break causing the ignition system to fail. The combustible train may also accumulate moisture which further reduces the efficiency and reliability of deploying the flare.

The end of the combustible train is approximately the size of the tip of a pencil. Thus, when the safe-and-initiation device is actuated upon deployment of the flare, the shock emitted by the ignition initiator must align perfectly with the end of the combustible train for flare ignition to proceed. This limitation also contributes to the reduced reliability and slow signal-to-impulse times of prior art flare ignition systems.

Accordingly, it would be a significant advancement in the art to provide an ignition system for decoy flares that can withstand the harsh environments to which it is subjected.

It would be a further advancement in the art to provide an ignition system for decoy flares that reliably ignites the flare illuminant while minimizing the time required for complete ignition.

It would also be an advancement in the art if such an ignition system included an illuminant igniter which provided a larger target for the ignition initiator.

Such an apparatus is disclosed and claimed herein.

BRIEF SUMMARY AND OBJECTS OF THE INVENTION

The present invention discloses an improved ignition system for igniting flares. In one preferred embodiment, the ignition system is included in a decoy flare having a housing with flare illuminant disposed within the housing. The illuminant is configured with an internal, longitudinal bore extending through the center of the flare illuminant. In one preferred embodiment, the bore has a rectangular cross section.

The ignition system includes an ignition initiator disposed at the aft end of the housing. The ignition system also includes an illuminant igniter positioned in direct contact with the flare illuminant.

The flare includes a safe-and-initiation device which is configured to actuate upon ejection of the flare from the flare canister. Upon actuation of the safe-and-initiation device,, combustion products from the ignition initiator are placed in communication with the illuminant igniter.

The illuminant igniter includes at least one illuminant igniter pellet selected such that the firing of the ignition initiator triggers combustion of the illuminant igniter pellet if the safe-and-initiation device has been actuated to a firing position.

In one preferred embodiment, the igniter pellet is made of boron potassium nitrate ($BKNO_3$) and is positioned in physical contact with the aft surface of the flare illuminant. This is preferably accomplished by bonding the pellet to the illuminant with an adhesive, such as a urethane based adhesive, which is compatible with the flare illuminant and the igniter pellet formulations. The igniter pellet is preferably configured as a circular cylindrical shell and is positioned over the bore of the flare illuminant.

As a result of the ignition system of the present invention, the signal-to-impulse time of the flare is decreased, and the reliability of ignition and deployment is improved over prior art ignition systems. This is primarily due to the fact that the present ignition system eliminates the use of the combustible train.

In addition, the use of the igniter pellet of the present invention provides a larger target for the flame of the safe-and-initiation system. The surface area of the igniter pellet is substantially increased over the target size of a typical combustible train.

Accordingly, it is a primary object of the invention to provide an ignition system with improved reliability and which is able to withstand the turbulent conditions and extreme temperature fluctuations encountered by decoy flares mounted on aircraft.

These and other objects and advantages of the invention will become apparent upon reading the following detailed description and appended claims, and upon reference to the accompanying drawings.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF THE PREFERRED EMBODIMENTS

Figure 1:
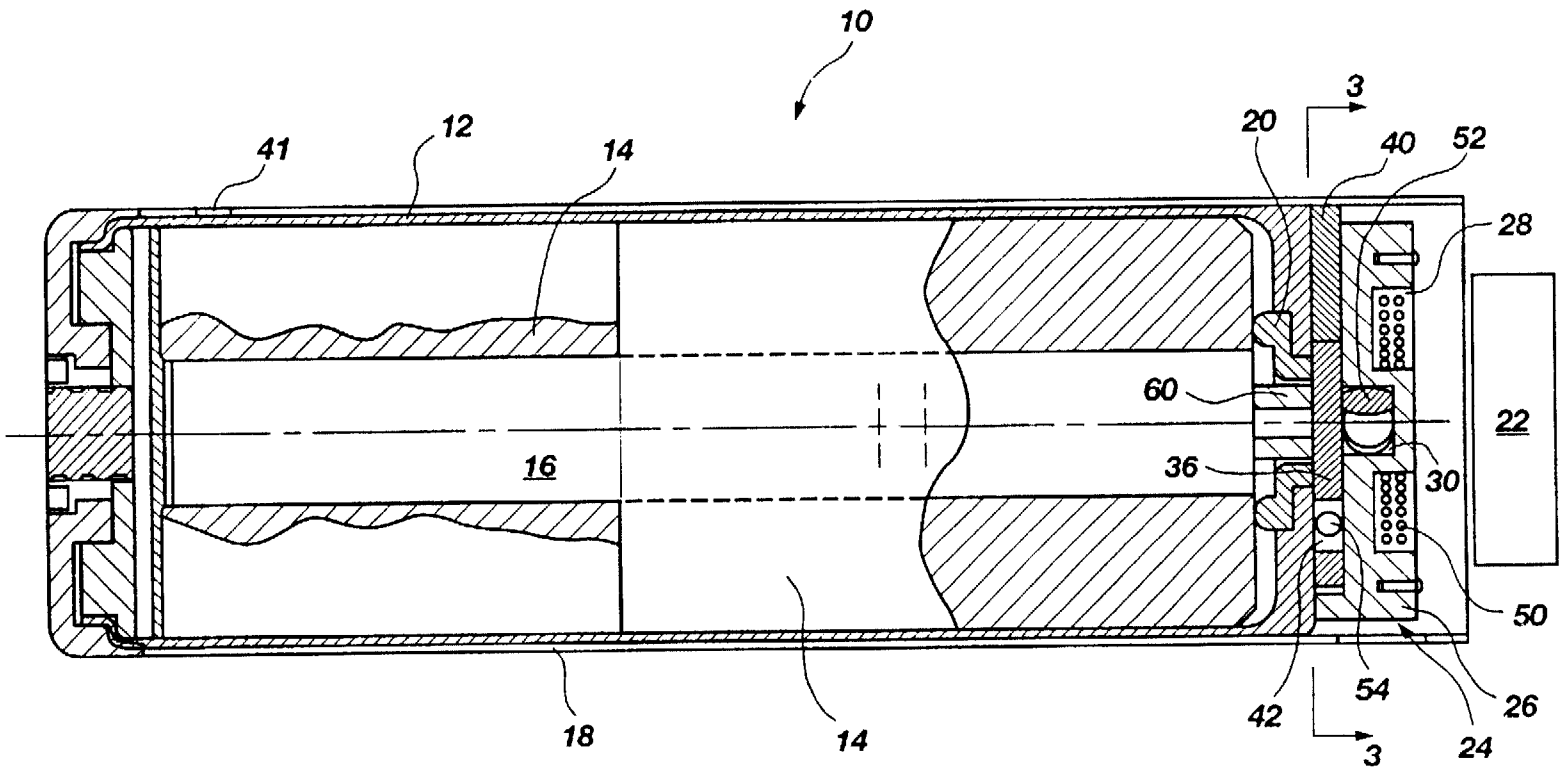
FIG. 1 is a cross-sectional view of one presently preferred embodiment of a decoy flare embodying an ignition system in accordance with the teachings of the present invention.

Reference is now made to the figures wherein like parts are referred to by like numerals throughout. With particular reference to FIG. 1, a decoy flare according to the present invention is generally designated at 10. The flare 10 includes a housing 12 in which illuminant 14 is disposed. The housing 12 may be manufactured of any of those materials known for use in such an application, but is preferably made of carbon steel.

In this preferred embodiment of the invention, the illuminant 14 is tailored to produce light in the infrared spectrum. The illuminant 14 is also preferably selected to be a composite illuminant/propellant, thereby enhancing the decoy characteristics of the flare. The propellant may be a single or multiple component composite system comprising acceptable oxidizers, fuels, binders, and infrared emitting compounds tailored to meet the performance objectives of the flare.

Figure 4:
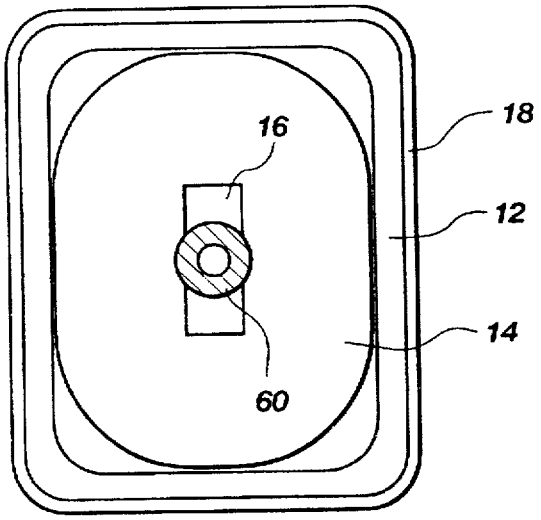
FIG. 4 is a cross-sectional view taken along line 4—4 of FIG. 1.

The illuminant grain is configured with an internal, longitudinal bore 16 extending through its center. In this preferred embodiment, the bore 16 has a rectangular cross section (FIG. 4). However, as one of skill in the art will appreciate, a variety of cross-sectional geometries may be employed to vary the burn characteristics of the propellant.

Figure 3:
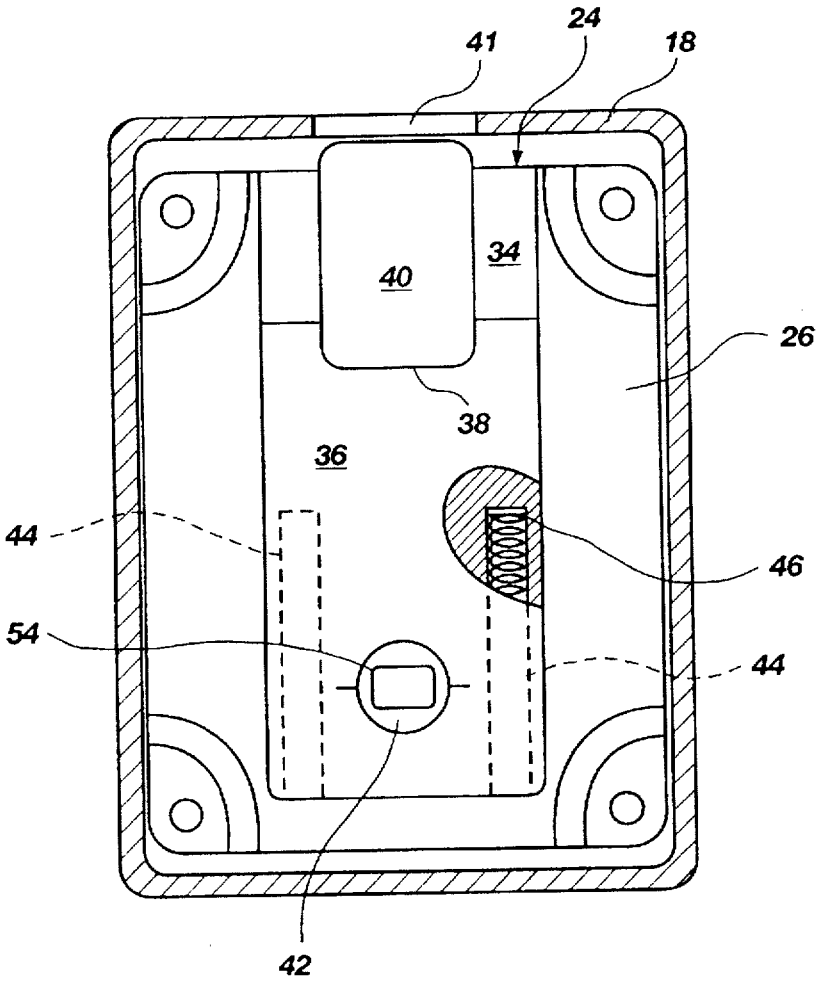
FIG. 3 is cross-sectional view taken along line 3—3 of FIG. 1, but with the shroud positioned in its extended position.

The flare 10 also includes a shroud 18 which is slidably attached to the housing 12 for deployment from the retracted position illustrated in FIG. 1 to an extended position (FIG. 3). During storage of the flare and prior to deployment, the shroud is maintained in the retracted position. Upon deployment of the flare and ignition of the illuminant, the shroud is deployed to the extended position. A locking mechanism maintains the shroud in the extended position, as is commonly known in the art of decoy flares.

A nozzle 20 is positioned in the aft end of the flare housing 12. The nozzle 20 is preferably made of a phenolic material and has a circular cross section.

The present invention also includes an ignition initiator. The configuration of the ignition initiator may vary substantially depending on the application for which the flare is to be used and on other physical design characteristics of the flare. In this embodiment, the ignition initiator comprises an impulse cartridge 22 which is provided within the cartridge which contains the flare. The impulse cartridge 22 is positioned such that it is located adjacent the aft end of the flare.

The impulse cartridge 22 may include any of those conventional ignition mechanisms, such as squibs, which are known for use as ignition mechanisms for flares. The impulse cartridge 22 receives an electrical signal from contacts in the dispenser which ignite the material found in the impulse cartridge, thereby producing a flame and gas which eject the flare from the case and trigger ignition of an ignition initiator.

Figure 2:
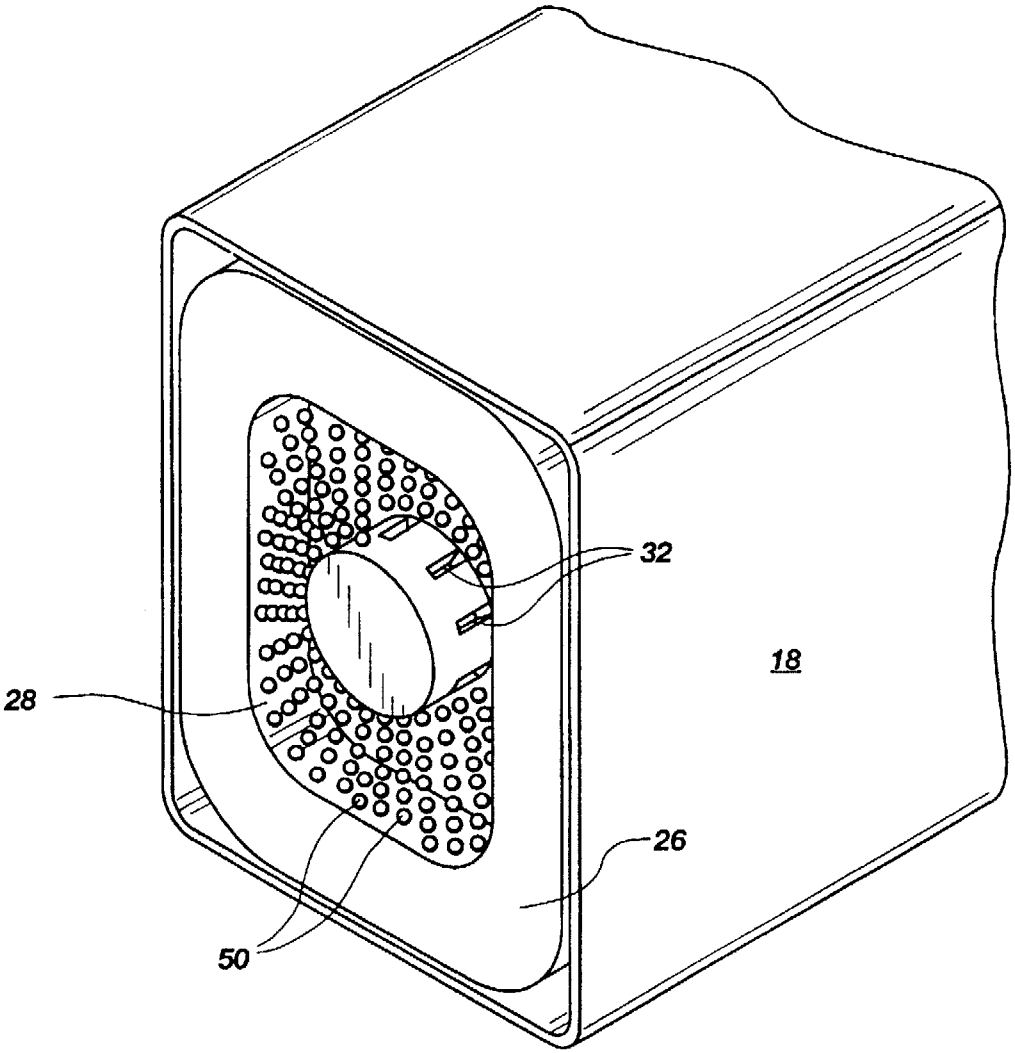
FIG. 2 is a perspective view of the aft end of the flare of FIG. 1, illustrating a portion of the safe-and-initiation device.

The flare further includes a safe-and-initiation device 24 which prevents the illuminant from being ignited unless the flare has been ejected from its canister. In accordance with the teachings of the present invention, a variety of safe-and-initiation devices may be employed, including any of those conventional safe-and-initiation devices known in the art. It is presently preferred, however, that the safe-and-initiation device 24 include a stationary plate 26 configured with an annular recess 28. The stationary plate 26 is further configured with a center pocket 30. As illustrated in FIG. 2, the annular recess 28 is placed in communication with the center pocket 30 via radial slots 32.

As illustrated in FIG. 3, the stationary plate 26 is configured with a track 34 in which a slidable barrier 36 is disposed. The slidable barrier includes a notch 38 for receiving a bore rider 40. Referring again to FIG. 1, the shroud 18 is configured with an orifice 41 which is sized and positioned to permit the bore rider 40 to be ejected into the airstream upon deployment of the shroud 18 to its extended position (illustrated in FIG. 3), as is explained below in greater detail.

The slidable barrier 36 is further configured with an ignition orifice 42, as illustrated in FIGS. 1 and 3. The slidable barrier 36 is configured such that when the flare is stowed in its canister, as illustrated in FIG. 1, the orifice 42 is not aligned with the nozzle 20. Thus, if the impulse cartridge 22 should fire without ejection of the flare from its cartridge, any combustion products generated by the impulse cartridge and any ignition pyrotechnics associated therewith will be isolated from the illuminant 14 by the slidable barrier 30.

As illustrated in FIG. 3, the slidable barrier 30 is further configured with two internal holes 44. A compression spring 46 is positioned in each hole 44 in a compressed state. Thus, upon ejection of the flare from the flare canister during deployment of the flare, the shroud 18 deploys to its extended position thereby aligning orifice 41 with the bore rider 40, as illustrated in FIG. 3. The force of the compression springs 46 pushes the slidable barrier 36 into a firing position, thereby propelling the bore rider 40 through the orifice 41 in the shroud 18 and into the air stream. Thus, FIG. 3 illustrates the position of the safe-and-initiation device 24 at the instant after the shroud 18 has deployed to its extended position but before the bore rider 40 is ejected through the orifice 41.

Importantly, the orifice 41 is configured just long enough to permit the bore rider 40 to pass through it, thereby permitting the shroud 18 to act as a stop with respect to the slidable barrier 36. With the slidable barrier 36 in the firing position (not shown), the ignition orifice 42 is in alignment with the nozzle 20 and the center pocket 30 of the stationary plate 26.

In this embodiment of the present invention illustrated in FIG. 1, the ignition initiator also includes a number of pyrotechnic pellets and granules which are positioned relative to a safe-and-initiation device 24. Pyrotechnic granules 50 are positioned within the annular recess 28 of the stationary plate 26. Preferably, about 3.0 grams of $BKNO_3$ granules are utilized for this purpose. The granules 50 are easily ignited upon the firing of the impulse cartridge 22.

The ignition initiator further includes three $BKNO_3$ size "2D" pellets 52 positioned in the center pocket 30 of the stationary plate 26. Thus, upon combustion of the granules 50, the combustion products will flow through the radial slots 32 (FIG. 2) and ignite the pellets 52.

Additional pellets 54 are included within the ignition orifice 42 of the slidable barrier 36. Preferably, a single size "2A" $BKNO_3$ pellet is used in this location. If the safe-and-initiation device 24 has been actuated to a firing position wherein the ignition orifice 42 is aligned with the center pocket 30, the firing of the pellets 52 in the center pocket will ignite the pellets 54 in the ignition orifice.

In accordance with the teachings of the present invention, the flare 10 also includes an illuminant igniter which comprises at least one illuminant igniter pellet 60 selected such that the firing of the ignition initiator triggers combustion of the igniter pellet if the safe-and-initiation device has been actuated to a firing position. As illustrated in FIGS. 1 and 4, the igniter pellet 60 is positioned in physical contact with the aft surface of the flare illuminant 14. Preferably, the igniter pellet 60 is positioned over the bore 16 of the flare illuminant 14.

The igniter pellet 60 is preferably configured as a circular cylindrical shell having an outside diameter approximately the same diameter of the nozzle 20, thereby providing a large area of pyrotechnic material which is exposed to the pellets 54 within the ignition orifice 42 of the safe-and-initiation device 24. While it is presently preferred to use a single pellet 60 of the geometric configuration described herein, the shape, size, weight, and number of igniter pellets employed may vary according to the ignition requirements of the illuminant formulation. The illuminant igniter pellet 14 may be pressed, extruded, or cast according to the requirement imposed for the pellet use.

In a preferred embodiment of the invention, the igniter pellet 60 is bonded to the illuminant grain 14. It is presently preferred that the igniter pellet 60 be bonded to the illuminant grain 14 by two adhesion points. The igniter pellet 60 may be bonded to the illuminant grain 14 with any adhesive which is compatible with both the igniter pellet and the illuminant grain formulations. If, for example, the presently preferred $BKNO_3$ igniter pellet is being bonded to a typical flare formulation. Depending on the illuminant formulation, one skilled in the art will appreciate that other types of adhesives, such as an epoxy-based adhesive, may be required.

In operation, the flare 10 is deployed by igniting the impulse cartridge 22 or other external firing means well known in the art. Firing of the impulse cartridge 22 ignites the pyrotechnic granules 50 positioned in the annular recess 28 of the stationary plate 26. The gases which are produced eject the flare from its canister and allow safe-and-initiation device to be actuated to the firing position. Thus, the slidable barrier 36 of the safe-and-initiation device moves under the force applied by the springs 46 (FIG. 3) to a position wherein the ignition orifice 42 is aligned with the igniter pellet 60 and the center pocket 30 of the stationary plate 26.

Combustion of the granules 50 results in the ignition of the pellets 52 in the center pocket 30, which, in turn, ignite the pellets 54 located within the ignition orifice 42 of the slidable barrier 36. Finally the igniter pellet 60 is ignited which causes the illuminant 14 to ignite.

In contrast to prior-art ignition systems which utilize a combustible train for the ignition of the illuminant, the ignition system of the present invention provides a pyrotechnic pellet bonded to the illuminant grain. As a result, the ignition system of the present invention can better withstand the turbulent and extreme temperature conditions experienced by many decoy flares. In addition, the ignition system of the present invention is faster and more reliable than prior art ignition systems.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An ignition system for igniting flare illuminant in a decoy flare, comprising:

an ignition initiator; and at least one illuminant igniter pellet in communication with the ignition initiator such that the firing of the ignition initiator triggers combustion of the illuminant igniter pellet, the pellet positioned in physical contact with the flare illuminant.

2. An ignition system as defined in claim 1, wherein the igniter pellet is bonded to the flare illuminant with an adhesive, the adhesive being compatible with the flare illuminant and the igniter pellet formulations.

3. An ignition system as defined in claim 2, wherein the adhesive is urethane based.

4. An ignition system as defined in claim 1, wherein the igniter pellet comprises $BKNO_3$.

5. An ignition system as defined in claim 1, wherein the igniter pellet is in the shape of a cylinder.

6. An ignition system as defined in claim 1, wherein the flare illuminant is configured with a longitudinal bore having a center and the igniter pellet is positioned over the center of the bore.

7. A decoy flare configured for launching from a flare canister, comprising:

a housing having an aft end;

flare illuminant disposed within the housing;

an ignition initiator disposed at the aft end of the housing;

an illuminant igniter positioned in direct contact with the flare illuminant;

a safe-and-initiation device configured to actuate upon ejection of the flare from the flare canister such that upon actuation of the safe-and-initiation device, combustion products from the ignition initiator are placed in communication with the illuminant igniter, the illuminant igniter comprising at least one illuminant igniter pellet selected such that the firing of the ignition initiator triggers combustion of the illuminant igniter pellet if the safe-and-initiation device has been actuated.

8. An ignition system as defined in claim 7, wherein the igniter pellet is bonded to the flare illuminant with an adhesive, the adhesive being compatible with the flare illuminant and the igniter pellet formulations.

9. An ignition system as defined in claim 8, wherein the adhesive is urethane based.

10. An ignition system as defined in claim 7, wherein the igniter pellet comprises $BKNO_3$.

11. An ignition system as defined in claim 7, wherein the igniter pellet is in the shape of a circular cylindrical shell.

12. An ignition system as defined in claim 7, wherein the flare illuminant is configured with a longitudinal bore having a center and the igniter pellet is positioned over the center of the bore.

13. An ignition system as defined in claim 12, wherein the longitudinal bore has a rectangular cross section.

14. The ignition system of claim 1, wherein said igniter pellet comprises means for increasing the surface area.

15. The ignition system of claim 1, wherein said igniter pellet has at least one opening.

16. The ignition system of claim 1, wherein said igniter pellet is in the shape of a cylindrical shell.

17. The ignition system of claim 6, wherein said igniter pellet has an opening and said opening is aligned with said longitudinal bore.

18. The decoy flare of claim 7, wherein said at least one igniter pellet comprises means for increasing the surface area.

19. The decoy flare of claim 7, wherein said at least one igniter pellet has a center opening.

20. The decoy flare of claim 12, wherein said igniter pellet has an opening and said opening is aligned with said longitudinal bore.

* * * * *